US010619263B2

(12) United States Patent
Brandl et al.

(10) Patent No.: US 10,619,263 B2
(45) Date of Patent: Apr. 14, 2020

(54) METHOD FOR THE NANOSTRUCTURING AND ANODIZATION OF A METAL SURFACE

(71) Applicant: EADS DEUTSCHLAND GMBH, Ottobrunn (DE)

(72) Inventors: Erhard Brandl, Eitensheim (DE); Ante Kurtovic, Paderborn (DE); Tobias Mertens, Munich (DE)

(73) Assignee: Airbus Defence and Space GmbH, Ottobrunn (DE)

( * ) Notice: Subject to any disclaimer, the term of this patent is extended or adjusted under 35 U.S.C. 154(b) by 182 days.

(21) Appl. No.: 14/647,056

(22) PCT Filed: Oct. 10, 2013

(86) PCT No.: PCT/DE2013/000582

§ 371 (c)(1),
(2) Date: May 22, 2015

(87) PCT Pub. No.: WO2014/079402

PCT Pub. Date: May 30, 2014

(65) Prior Publication Data

US 2015/0275387 A1 Oct. 1, 2015

(30) Foreign Application Priority Data

Nov. 22, 2012 (DE) ..... 10 2012 022 758
Nov. 22, 2012 (DE) ..... 10 2012 022 759

(51) Int. Cl.
*C25D 11/16* (2006.01)
*C23C 28/00* (2006.01)
(Continued)

(52) U.S. Cl.
CPC ..... *C25D 9/06* (2013.01); *C25D 5/02* (2013.01); *C25D 5/34* (2013.01); *C25D 11/16* (2013.01);
(Continued)

(58) Field of Classification Search
CPC . C25D 5/36; C25D 5/38; C25D 11/26; C25D 11/30; C25D 11/34; C25D 11/024; C25D 11/16; C23C 28/00
(Continued)

(56) References Cited

U.S. PATENT DOCUMENTS

2001/0010973 A1 8/2001 Aiba et al.
2008/0011175 A1 1/2008 Herzbach et al.

FOREIGN PATENT DOCUMENTS

CN 101519783 A * 9/2009 ..... C23F 17/00
CN 101519783 A * 9/2009 ..... B22F 1/02

OTHER PUBLICATIONS

Wang et al., "Engineering a Titanium Surface With Controllable Oleophobicity and Switchable Oil Adhesion," J. Phys. Chem. C (no month, 2010), vol. 114, pp. 9938-9944.*

(Continued)

*Primary Examiner* — Edna Wong
(74) *Attorney, Agent, or Firm* — Crowell & Moring LLP

(57) ABSTRACT

A method is provided for the nanostructuring and oxidation of a surface, which has an anodizable metal and/or an anodizable metal alloy, both being coated with an oxide layer, by way of a laser or particle radiation in an inert or reactive atmosphere and subsequent anodization. As a result, oxide nanostructures are formed on the entire surface, in titanium or titanium alloys in the form of nanotubes.

17 Claims, 3 Drawing Sheets

(51) Int. Cl.

| | |
|---|---|
| ***C25D 9/06*** | (2006.01) |
| ***C25D 11/26*** | (2006.01) |
| ***C25D 11/30*** | (2006.01) |
| ***C25D 11/34*** | (2006.01) |
| ***C25D 5/02*** | (2006.01) |
| ***C25D 5/34*** | (2006.01) |

(52) U.S. Cl.
CPC ..... *C25D 11/26* (2013.01); *C25D 11/30* (2013.01); *C25D 11/34* (2013.01)

(58) Field of Classification Search
USPC ..... 205/205, 199, 200, 201
See application file for complete search history.

(56) References Cited

OTHER PUBLICATIONS

Ou et al., "Tunable Water Adhesion on Titanium Oxide Surfaces with Different Surface Structures," ACS Appl. Mater. Interfaces (no month, 2012), vol. 4, pp. 5737-5741.*
Dahotre et al., "Wetting Behaviour of Laser Synthetic Surface Microtextures on Ti-6Al-4V for Bioapplication," Phil. Trans. R. Soc. A (no month, 2010), vol. 368, pp. 1863-1889.*
Gyorgy et al., "Surface Nitridation of Titanium by Pulsed Nd:YAG Laser Irradiation," Applied Surface Science (no month, 2002), vol. 186, pp. 130-134.*
Sun et al., "Hot Deformation Behavior and Microstructure Evolution of TC4 Titanium Alloy," Trans. Nonferrous Met. Soc. China (no month, 2010), vol. 20, pp. 2181-2184.*
Wang et al., "Engineering a Titanium Surface With Controllable Oleophobicity and Switchable Oil Adhesion," J. Phys. Chem. C (no month, 2010), vol. 114, pp. 9938-9944. (Year: 2010).*
Ou et al., "Tunable Water Adhesion on Titanium Oxide Surfaces with Different Surface Structures," ACS Appl. Mater. Interfaces (no month, 2012), vol. 4, pp. 5737-5741. (Year: 2012).*
Zorba et al., "Biomimetic Artificial Surfaces Quantitatively Reproduce the Water Repellency of a Lotus Leaf," Adv. Mater. (no month, 2008), vol. 20, pp. 4049-4054. (Year: 2008).*
Kietzig et al., "Patterned Superhydrophobic Metallic Surfaces," Langmuir (no month, 2009), vol. 25, No. 8, pp. 4821-4827. (Year: 2009).*
Dahotre et al., "Wetting Behaviour of Laser Synthetic Surface Microtextures on Ti-6Al-4V for Bioapplication," Phil. Trans. R. Soc. A (no month, 2010), vol. 368, pp. 1863-1889. (Year: 2010).*
Gyorgy et al., "Surface Nitridation of Titanium by Pulsed Nd:YAG Laser Irradiation," Applied Surface Science (no month, 2002), vol. 186, pp. 130-134. (Year: 2002).*
Wang et al., "Engineering a Titanium Surface with Controllable Oleophobicity and Switchable Oil Adhesion," J. Phys. Chem. C (2010), vol. 114, pp. 9938-9944. (Year: 2010).*
Ou et al., "Tunable Water Adhesion on Titanium Oxide Surfaces with Different Surface Structures," ACS Appl. Mater. Interfaces (2012), vol. 4, pp. 5737-5741. (Year: 2012).*
Dahotre et al., "Wetting Behaviour of Laser Synthetic Surface Microtextures on Ti-6Al-4V for Bioapplication," Phil. Trans. R. Soc. A (2010), vol. 368, pp. 1863-1889. (Year: 2010).*
Gyorgy et al., "Surface Nitridation of Titanium by Pulsed Nd:YAG Laser Irradiation," Applied Surface Science (2002), vol. 186, pp. 130-134. (Year: 2002).*
Varlamova et al., "The Laser Polarization as Control Parameter in the Formation of Laser-Induced Periodic Surface Structures: Comparison of Numerical and Experimental Results," Applied Surface Science (2011), vol. 237, pp. 5465-5469. (Year: 2011).*
Bertrand et al., Effect of the Combination of Different Welding Parameters on melting Characteristics of Grade 1 Titanium with a Pulsed Nd-YAG Laser, Laser Med Sci (2007), vol. 22, pp. 237-244. (Year: 2007).*
International Search Report (PCT/ISA/220 and PCT/ISA/210) dated Oct. 27, 2014 with English translation (10 pages).
Macak et al. "Influence of different fluoride containing electrolytes on the formation of self-organized titania nanotubes by Ti anodization", Journal of Electroceramics, Feb. 2006, vol. 16, No. 1, pp. 29-34, XP019208330.
Wang et al. "Engineering a Titanium Surface with Controllable Oleophobicity and Switchable Oil Adhesion", Journal of Physical Chemistry C., Jun. 3, 2010, vol. 114, No. 21, pp. 9938-9944, XP055123253.

* cited by examiner

METHOD FOR THE NANOSTRUCTURING AND ANODIZATION OF A METAL SURFACE

FIELD OF THE INVENTION

The invention relates to a method for nanostructuring and oxidizing a surface that comprises an anodizable metal and/or an anodizable metal alloy, which can both be coated with an oxide layer, by way of laser radiation or particle radiation in an inert or reactive atmosphere, and subsequent anodizing.

BACKGROUND OF THE INVENTION

The anodizing of metals and metal alloys is a well-known process. In this process, a material made of an anodizable metal or an anodizable metal alloy is used as the anode in an electrolytic cell, which moreover comprises a cathode (usually made of noble metal) connected to the anode and an electrolyte having a suitable oxidizing agent. The surface of the metal or of the metal alloy is oxidized when a voltage is applied. In electrolytes that, moreover, contain a suitable concentration of an addition that dissolves the metal oxide again, the method can be carried out under suitable conditions in such a way that a smaller portion of the oxidized surface continues to be dissolved out by the electrolyte, while a larger portion of the surface continues to be oxidized. In this way, structures having micrometer or nanometer dimensions can be created on the oxidized surface, which in the special case of titanium are present in the form of nanotubes.

In many cases, however, these surfaces comprise regions that have no nanostructures after anodizing.

SUMMARY OF THE INVENTION

The invention relates to a method for nanostructuring and oxidizing a surface of a material that comprises an anodizable metal and/or an anodizable metal alloy, which can both be at least partially covered with an oxide layer, wherein the surface of the metal and/or of the metal alloy and/or of the oxide layer on the metal and/or the metal alloy, which is accessible to laser irradiation or to irradiation using a particle beam and on which the structures are to be generated, is completely scanned one or more times using a pulsed laser beam, or a continuous particle beam, which is selected from an electron beam or an ion beam or an uncharged particle beam or a combination thereof, in such a way that neighboring light spots of the laser beam or scanning spots of the particle beam abut each other without gaps or overlap each other, wherein the following conditions are adhered to:

when scanning is carried out using a laser beam and the pulse duration of the laser pulses t is approximately 0.1 ns to approximately 2000 ns, an ε-value of approximately $0.07 \leq \varepsilon \leq$ approximately 2300, wherein $$\varepsilon = \frac{P_P^2 \cdot \sqrt{P_m} \cdot f \cdot \alpha \cdot \sqrt{t} \cdot \sqrt{\kappa}}{d^2 \cdot \sqrt{v} \cdot \sqrt{T_V} \cdot \sqrt{c_P} \cdot \sqrt{\lambda}} \cdot 10^3 \quad \text{(Equation 1)}$$

or, when scanning is carried out using a laser beam at a wavelength of the laser λ of approximately $100 \leq \lambda \leq$ approximately 11,000 nm, and the pulse duration of the laser pulses t<approximately 0.1 ns, an $\varepsilon_1$-value of approximately $0.5 \leq \varepsilon_1 \leq$ approximately 1650, wherein $$\varepsilon_1 = \frac{P_P \cdot \sqrt{P_m} \cdot f \cdot \alpha \cdot \sqrt{t} \cdot \sqrt{\kappa}}{d^2 \cdot \sqrt{v} \cdot \sqrt{T_V} \cdot \sqrt{c_P}} \cdot 10^3 \quad \text{(Equation 2)}$$

where in Equation 1 and Equation 2:

$P_p$: pulse peak power of the exiting radiation [kW];

t: pulse duration of the pulses [ns];

f: repetition rate of the radiation pulses [kHz];

v: scanning speed on the workpiece surface [mm/s];

d: diameter of the energetic radiation on the material surface [μm];

α: absorption of the energetic radiation of the irradiated material [%] at the incident wavelength under normal conditions;

or, when scanning is carried out using a particle beam, an $\varepsilon_2$-value of approximately $0.5 \leq \varepsilon_2 \leq$ approximately 1550, wherein $$\varepsilon_2 = \frac{P_m^2 \cdot \sqrt{\kappa} \cdot \alpha}{\sqrt{d^3} \cdot \sqrt{v} \cdot \sqrt{T_V} \cdot \sqrt{c_P}} \cdot 10^2 \quad \text{(Equation 3)}$$

where in Equation 3:

v: scanning speed on the workpiece surface [mm/s];

d: diameter of the energetic radiation on the material surface [μm];

with the proviso that d/v<approximately 7000 ns;

α: absorption of the energetic radiation of the radiated material [%] under normal conditions;

and in Equation 1, Equation 2 and Equation 3:

$P_m$: average power of the exiting radiation [W];

$T_V$: evaporation or decomposition temperature of the material [K] at normal pressure;

$c_p$: specific heat capacity [J/kgK] at normal conditions;

κ: specific thermal conductivity [W/mK] at normal conditions and averaged across the different spatial directions;

wherein the atmosphere in which the method is carried out is a vacuum or a gas or gas mixture that is inert with respect to the surface under the method conditions, or a gas or gas mixture that is reactive with respect to the metal and/or the metal alloy and/or the oxide layer on the metal and/or the metal alloy of the surface under the method conditions, the gas or gas mixture chemically modifying the metal and/or the metal alloy and/or the oxide layer on the metal and/or the metal alloy during or after scanning using the laser beam or particle beam compared to the composition of the same prior to scanning using the laser beam or particle beam; and the surface is subsequently anodized by immersion in an electrolyte solution, which contains both an oxidizing agent and an agent dissolving the oxide again, which may optionally be identical to the oxidizing agent, by connecting to a cathode, and by applying a voltage.

DETAILED DESCRIPTION OF PREFERRED EMBODIMENTS

Figure 1:
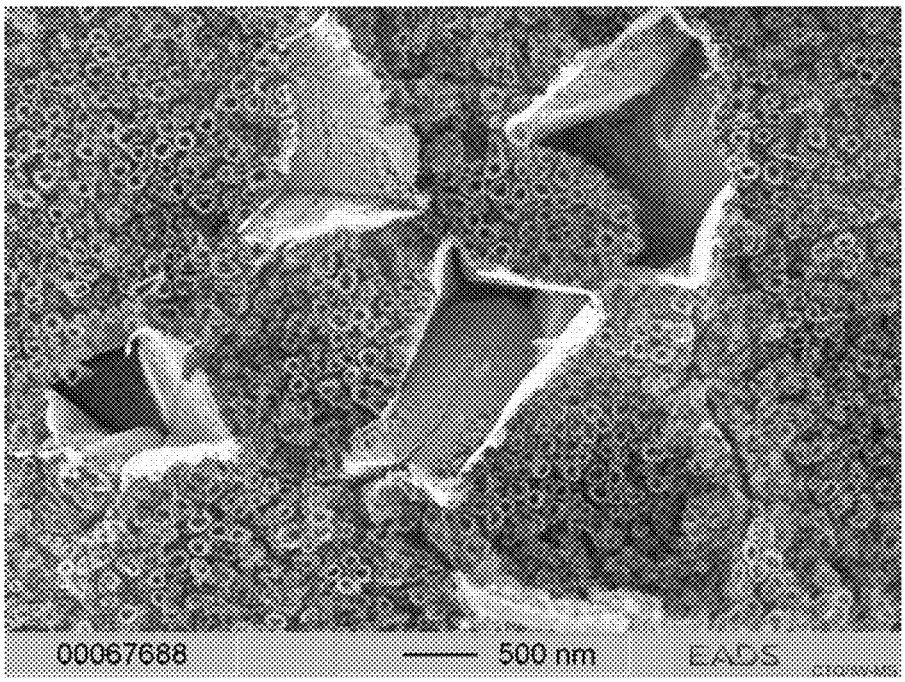
FIG. 1 shows the surface of a Ti-6Al-4V alloy after simple anodizing.

Surprisingly, it was found that a consecutive treatment of a metal surface or metal alloy surface of a material optionally comprising an oxide coating by nanostructuring by way of laser radiation or particle radiation in an inert or reactive atmosphere, and subsequent anodizing of the entire surface, can be used to create nanostructures of an oxide of the metal or of the metal alloy, which in the case of titanium can be present in the form of nanotubes. After this treatment, no areas of the surface remain in which no nanostructuring is present. It was furthermore found that the nanostructures thus created are finer, and the nanostructure is more homogeneous, than those created solely by anodizing of the material.

Roughening or structuring of surfaces in the nanometer range is in particular essential for good adhesion of adhesives, paints, biological tissue, and other coatings, such as thermal insulation layers and metallic adhesion promoter layers.

One-time or multiple irradiation by way of a pulsed laser beam, or a continuous particle beam, in an inert or reactive atmosphere under the conditions mentioned in the above-described method can generate nanostructured surfaces that ensure good adhesion, for example of adhesives, paints, solder, sealant, bone cement, adhesion promoter, or biological tissue, and of other coatings, such as coatings for protection against chemical or thermal action. Optionally, it is possible to even bond, with adhesive strength, two materials to each other solely by joining under pressure if such nanostructures were created on at least one material.

Depending on the design, the surfaces generated by laser radiation or particle radiation and provided with surface structures, which are chemically modified compared to the starting surface when working in a reactive atmosphere, can generally have open-pored, rimose and/or fractal-like nanostructures, such as open-pored mountain and valley structures, open-pored undercut structures, and cauliflower- or nodule-like structures. These structures in general cover the entire metal or metal alloy surface treated with the radiation.

The scanning of the starting surface using the laser beam or particle beam can be carried out once, or consecutively multiple times, using the same process parameters and the same laser beam or particle beam, or using different process parameters and the same laser beam or particle beam, or using different laser beams and/or particle beams and the same process parameters or different process parameters. In some circumstances, it can be possible to create an even finer structure by multiple scanning.

It is necessary to mention that, by nature, only those surface regions that can be reached by a laser beam or particle beam can be treated. Regions that are located completely "shadowed" (in undercut geometries, for example) cannot be structured in the manner described herein.

The starting surface that comprises the metal or the metal alloy and/or optionally an oxide layer on the same, is frequently not pretreated or cleaned prior to scanning using the laser beam or particle beam; however, the surface can also be cleaned with a solvent or pickled, for example.

As described above, structuring using a laser beam or particle beam alone, in particular, ensures good adhesion of a large number of materials. However, there are also instances in which oxidation of the surface simultaneously with a nano structuring process is desirable or necessary, the surface being more uniform and/or having a larger layer thickness, and in particular being even more porous than an oxide layer optionally remaining after the treatment using the laser beam or particle beam (if a surface coated with oxide formed the starting basis).

The metal and/or metal alloy that are present in the surface and, optionally, may be coated at least partially with an oxide layer, are selected from anodizable metals and/or metal alloys. These include in particular aluminum, titanium, magnesium, iron, cobalt, zinc, niobium, zirconium, hafnium, tantalum, vanadium and/or the alloys thereof, and steel. In addition to pure titanium, in particular cobalt-chromium alloys, cobalt-chromium-molybdenum alloys, and the alloys Ti-6Al-4V, Mg-4Al1-Zn, Ta-10W, Al 2024 (Al-4.4Cu-1.5Mg-0.6Mn) and V2A steel (X5CrNi18-10) should be mentioned.

The metal and/or the metal alloy, which optionally may be coated at least partially with an oxide layer, can also be present in a metal-ceramic composite material or a composite material composed of a metal and/or a metal alloy containing heat-conducting, carbon-containing and/or boron nitride-containing particles and/or fibers.

The pressure that is present in the method according to the invention is generally in the range of approximately $10^{-17}$ bar to approximately $10^{-4}$ bar, when working under vacuum, and in the range of approximately $10^{-6}$ bar to approximately atmospheric pressure in the case of particle beams, and up to approximately 15 bar in the case of laser beams, when working in an atmosphere composed of an intentionally added inert or reactive gas or gas mixture. The temperature outside the laser beam or particle beam is generally in the range of approximately −50° C. to approximately 350° C. (in the beam, of course, temperatures may be considerably higher).

The evaporation or decomposition point at normal pressure, the specific heat capacity $c_p$ at normal conditions, the specific thermal conductivity $\kappa$, averaged across the different spatial directions, at normal conditions, and the absorption of energetic radiation of the irradiated material $\alpha$, which in the case of laser radiation is dependent on the wavelength of the laser radiation, at normal conditions, which must be inserted into the above-mentioned expression for $\varepsilon$ or $\varepsilon_1$ or $\varepsilon_2$, are material properties of the treated metal or the treated metal alloy. In metals or metal alloys covered with an oxide layer, the data of the underlying metal or metal alloy is used for the evaporation or decomposition point at normal pressure, the specific heat capacity $c_p$ at normal conditions, and the specific thermal conductivity $\kappa$ at normal conditions.

Equation 1

Values of $\varepsilon$ that must result from the parameters of the above-described Equation 1 for the surface structuring desired according to the invention to be created are preferably approximately $0.07 \leq \varepsilon \leq$ approximately 2000, more preferably approximately $0.07 \leq \varepsilon \leq$ approximately 1500.

Preferred parameters of the method of the invention for Equation 1 are provided hereafter. It must be emphasized that all parameters can be varied independently of each other.

The laser wavelength λ can be approximately 100 nm to approximately 11,000 nm.

The pulse duration of the laser pulses t is preferably approximately 0.1 ns to approximately 300 ns, more preferably approximately 5 ns to approximately 200 ns.

The pulse peak power of the exiting laser radiation $P_p$ is preferably approximately 1 kW to approximately 1800 kW, more preferably approximately 3 kW to approximately 650 kW.

The average power of the exiting laser radiation $P_m$ is preferably approximately 5 kW to approximately 28,000 W, more preferably approximately 20 W to approximately 9500 W.

The repetition rate of the laser pulses f is preferably approximately 10 kHz to approximately 3000 kHz, more preferably approximately 10 kHz to approximately 950 kHz.

The scanning speed on the workpiece surface v is preferably approximately 30 mm/s to approximately 19,000 mm/s, more preferably approximately 200 m/s to approximately 9000 mm/s.

The diameter of the laser beam on the workpiece d is preferably approximately 20 μm to approximately 4500 μm, more preferably approximately 50 μm to approximately 3500 μm.

Equation 2

The values of $\varepsilon_1$ that must result from the parameters of the above-described Equation 2 for the surface structuring desired according to the invention to be created are preferably approximately $0.7 \leq \varepsilon_1 \leq$approximately 1500, more preferably approximately $0.9 \leq \varepsilon_1 \leq$approximately 1200.

The laser wavelength λ is approximately 100 nm to approximately 11,000 nm.

Preferred parameters of the method of the invention for Equation 2 are provided hereafter. It must be emphasized that all parameters can be varied independently of each other.

The pulse duration of the radiation t is preferably approximately 0.005 ns to approximately 0.01 ns, more preferably approximately 0.008 ns to approximately 0.01 ns.

The pulse peak power of the exiting radiation $P_p$ is preferably approximately 100 kW to approximately 30,000 kW, more preferably approximately 150 kW to approximately 25,000 kW.

The average power of the exiting radiation $P_m$ is preferably approximately 5 W to approximately 25,000 W, more preferably approximately 20 W to approximately 9500 W.

The repetition rate of the radiation f is preferably approximately 100 kHz to approximately 80,000 kHz, more preferably approximately 120 kHz to approximately 20,000 kHz.

The scanning speed on the workpiece surface v is preferably approximately 30 mm/s to approximately 60,000 mm/s, more preferably approximately 200 m/s to approximately 50,000 mm/s.

The diameter of the laser beam on the workpiece d is preferably approximately 20 μm to approximately 4500 μm, more preferably approximately 50 μm to approximately 3500 μm.

Lasers that can be used include pulsed solid-state lasers such as Nd:YAG (λ=1064 nm or 533 nm or 266 nm), Nd:$YVO_4$ (λ=1064 nm), diode lasers with λ=808 nm, for example, gas lasers such as excimer lasers, with KrF (λ=248 nm) or $H_2$ (λ=123 nm or 116 nm), for example, or a $CO_2$ laser (10,600 nm).

Equation 3

The values of $\varepsilon_2$ that must result from the parameters of the above-described Equation 3 for the surface structuring desired according to the invention to be created are preferably approximately $0.7 \leq \varepsilon_2 \leq$approximately 1400, more preferably approximately $0.9 \leq \varepsilon_2 \leq$approximately 1100.

Preferred parameters of the method of the invention for Equation 2 are provided hereafter. It must be emphasized that all parameters can be varied independently of each other.

The average power of the exiting radiation $P_m$ is preferably approximately 1 W to approximately 25,000 W, more preferably approximately 20 W to approximately 9500 W.

The scanning speed on the workpiece surface v is preferably approximately 100 mm/s to approximately 8,000,000 mm/s, more preferably approximately 200 m/s to approximately 7,000,000 mm/s.

The diameter of the particle beam on the workpiece d is preferably approximately 20 μm to approximately 4500 μm, more preferably approximately 50 μm to approximately 3500 μm.

The ratio of beam diameter to scanning speed is subject to a limitation, since d/v<approximately 7000 ns is required.

The person skilled in the art is familiar with suitable radiation sources for electron beams, ion beams and uncharged particle beams.

The atmosphere in which the work of the method is carried out can be a vacuum, or a gas or gas mixture that is inert with respect to the surface under the conditions of the method, wherein the inert gases can be a noble gas, such as argon, helium or neon, or in many cases nitrogen or $CO_2$, or a mixture of these gases, depending on the surface and conditions of the method. The inert gas or gas mixture is selected so as not to react with the metal, the metal alloy, or an oxide layer provided thereon, under the working conditions of pressure and temperature for a particular metal, metal alloy or oxide layer on the same.

When working under vacuum without a gas addition, the pressure is preferably $10^{-17}$ to $10^{-4}$ bar. When working with an inert gas addition, the pressure is generally $10^{-6}$ to 1 bar when particle beams are used, and up to 15 bar when laser beams are used. Ambient pressure and temperature are preferred if the particular surface allows.

On the other hand, the atmosphere in which the work of the method according to the invention is carried out can comprise a reactive gas, by way of which the surface material according to the invention is chemically modified. Reactive gases in which the method can be carried out include, for example, inorganic gases or gas mixtures, such as hydrogen, air, oxygen, nitrogen, halogens, carbon monoxide, carbon dioxide, ammonia, nitrogen monoxide, nitrogen dioxide, nitrous oxide, sulfur dioxide, sulfur hydrogen, boranes and/or silanes (such as monosilane and/or disilane).

Organic gases or gases having organic groups can likewise be used. These include, for example, lower, optionally halogenated, alkanes, alkenes and alkynes, such as methane, ethane, ethene (ethylene), propene (propylene), ethyne (acetylene), methyl fluoride, methyl chloride and methyl bromide, and methylamine and methylsilane. A mixture of an inorganic and organic gas, or a gas containing organic groups, can also be used.

If a gas mixture is present, it suffices that a gas constituent thereof, or a mixture of multiple gas constituents, is a reactive gas; the remainder can be an inert gas, generally a noble gas. The concentration of the reacting gas or gas mixture can vary from a few ppb, such as 5 ppb, to more than 99 vol %.

The selection of the reactive gas or gas mixture depends, of course, on the intended modification of the surface material according to the invention. If an oxide-containing surface is to be reduced so as to introduce hydroxide groups, for example, naturally a reducing gas, such as hydrogen, will be used as the reactive gas (optionally mixed with an inert gas). In contrast, an oxygen-containing gas, for example, will be considered for oxidizing the surface. The person skilled in the art knows which reactive gas must be selected to achieve a desired effect in a particular surface material according to the invention.

The pressure of the reactive gas or gas mixture, which optionally comprises only a reactive gas component, is generally in the range of approximately $10^{-6}$ bar to approximately 1 bar when using a particle beam, and up to approximately 15 bar when using a laser beam. Atmospheric pressure is preferred. It is possible to work at gas temperatures that, outside the laser beam, are generally in the range of approximately −50° C. to approximately 350° C. Of course, considerably higher temperatures may develop in the laser beam.

The person skilled in the art can find out whether a chemical modification of a particular surface material has taken place by using suitable analysis method, such as X-ray photoelectron spectroscopy (XPS), energy dispersive X-ray analysis (EDX), FTIR spectroscopy, time-of-flight secondary ion mass spectrometry (ToF-SIMS), electron energy loss spectroscopy (EELS), high-angle annular dark field (HAADF) or near infrared (NIR) spectroscopy.

If the metal and/or the metal alloy was nanostructured on the workpiece surface as described above, the same is subjected to anodizing, in which the workpiece, which forms the anode, is immersed into an electrolyte solution, connected to a cathode generally comprising noble metal, and anodized by applying a voltage.

For the generation of highly porous oxide layers and/or oxide layers present in the form of nanotubes by way of anodizing, the electrolyte generally must have a dual function: it must continuously oxidize the metal or the metal alloy, and partially dissolve the formed oxide again. In this way, highly porous or nanotube structures are created. Accordingly, the electrolyte must contain an effective oxidizing agent and also an agent that ensures re-dissolution of the oxide.

The person skilled in the art knows numerous electrolytes and method conditions for anodizing.

In anodizing, an electrolyte solution is used which typically contains either an oxidizing inorganic or organic acid, or an oxidizing acid salt, or an alkaline hydroxide-based oxidizing agent, as the oxidizing agent. The organic acids and acid salts that can be used include, for example, sulfuric acid, chromic acid, phosphoric acid, nitric acid and ammonium sulfate; the organic acids that can be used include, for example, toluenesulfonic acid, benzenesulfonic acid and tartaric acid. Hydrochloric acid can be used to set a suitable pH. Hydroxide-containing alkaline oxidizing agents are frequently based on sodium hydroxide.

To achieve a microstructure or nanostructure, a portion of the formed oxide is caused to go into solution again. This can be carried out by using an acid, which can be a different acid, or in some cases the same acid, as that which is used for oxidation, or by using an acid salt. The counterion of the acid or the anion of the salt is frequently a chelating agent for the anodized metal or the anodized metal alloy.

For example, tartaric acid, the anion of which is a chelating agent, can be used as the oxide-dissolving agent, for example in conjunction with phosphoric acid as the (further) oxidizing agent. Hydrofluoric acid, or optionally ammonium fluoride, is also used frequently to re-dissolve the oxide.

One example in which the oxidizing acid is identical to the agent that re-dissolves the oxide is phosphoric acid in the case of anodizing aluminum, the sole use of which results in the formation of a microstructure or nanostructure.

The concentrations of the oxidizing agent and of the oxide-dissolving agent, which is frequently used in low molar concentration compared to the oxidizing agent, and the pH of the electrolyte solution vary depending on the metal or metal alloy and the desired layer thickness and porosity. This also applies to the voltage and temperature used in the respective method.

With some metals, in particular titanium and titanium alloys, ammonium sulfate can advantageously be used as the oxidizing agent, together with ammonium fluoride as the oxide-dissolving agent, which avoids the handling of extremely toxic hydrofluoric acid and is particularly preferred in the method according to the invention.

For example, the aqueous electrolyte in this preferred method variant generally comprises 10 to 1000 g/l, for example 100 to 500 or 160 g/l, preferably 120 to 140 g/l, and in particular 130 g/l ammonium sulfate, and generally 0.1 to 10 g/l, preferably 2 to 6 g/l, and in particular ammonium fluoride, wherein the temperatures are generally 20 to 50° C., preferably 22 to 28° C., and in particular 25° C., and a voltage of 1 to 60 V, preferably 10 to 20 V, is applied over a time period of 4 minutes to 24 hours, preferably 27 to 33 minutes, and in particular 30 minutes, if an oxide layer having a layer thickness in the range of 100 to 1000 nm, for example of 200 to 450 nm, or 300 to 400 nm, and for some purposes preferably of 340 to 360 nm, is to be generated, the entire surface of which is covered by nanotubes having a diameter in the range of 10 to 300 nm, for example of 20 to 220 nm, or also 180 nm, particularly preferably of 30 to 100, or 40 to 80 nm.

The method according to the invention can be used to generate oxide layers on metals and/or metal alloys that may potentially be covered with thin oxide layers, the oxide layers being present on the surface completely in nanostructured form, in particular in the form of nanotubes, and completely covering the metals or metal alloys.

The oxide layers generated according to the invention on metals or metal alloys, which have the above-described nanostructures, in particular nanotubes, ensure excellent adhesion, for example of adhesives, paints, solder, sealant, bone cement, adhesion promoter, or biological tissue, and of other coatings, such as coatings for the protection against chemical or thermal action. Moreover, if at least one workpiece comprises a surface produced according to the invention, two such workpieces can be joined to each other, or one such workpiece can be joined to a workpiece having a surface made of a different material, with satisfactory adhesion by mere joining under increased pressure at room temperature or at elevated temperatures.

The surfaces generated according to the invention, however, can also be used for purposes other than improved adhesion. The oxidation and nanostructuring cause changes in the physical and/or chemical interaction of the surface with light or matter. In particular, electrical conductivity is reduced, and resistance is increased. The color or emissivity of the surface is likewise changed.

The drastic increase in the surface as a result of the formation of nanostructures, in particular nanotubes, can moreover cause a drastic increase in catalytic effects of the surface itself, or of a thin and/or nanoscale coating on the same, for example with dyes or metal catalyst, since heterogeneous catalysis is known to be a surface phenomenon. Purely physical phenomena, such as the increase in the number of spots in which seed crystals or bubble nuclei can form, can also be taken advantage of.

One example of particularly preferred workpieces having a surface produced according to the invention are metal prostheses and implants that comprise titanium or a titanium alloy, for example. The porous surfaces ensure that the biological materials in the body, to which they are supposed to grow, excellently adhere to these surfaces.

The following examples explain the invention in more detail.

EXAMPLES

Comparison Example 1

Anodizing a Ti-6Al-4V Surface

A pickled Ti-6Al-4V surface was anodized as follows:

A workpiece made of Ti-6Al-4V having a pickled surface was immersed into an aqueous electrolyte solution at 25° C., which contained 130 g/l ammonium sulfate and 0.5 g/l ammonium fluoride.

A voltage from 10 to 25 V was applied for 30 minutes between the Ti-6Al-4V workpiece, which was used as the anode, and a noble metal cathode.

The resulting surface, which in addition to regions having nanotubes also comprises large regions having no structuring (α-phase of the Ti-6Al-4V structure) on the surface, is shown in FIG. 1.

Comparison Example 2

Nanostructuring a Ti-6Al-4V Surface by Way of Pulsed Laser Radiation in an Inert Atmosphere A Ti-6Al-4V workpiece having a pickled surface was scanned once using a diode-pumped Nd:$YVO_4$ (neodymium-doped yttrium orthovanadate) laser (wavelength λ: 1064 nm) in an argon atmosphere at ambient pressure and ambient temperature.

The remaining method parameters were:

$P_p$ (pulse peak power of the exiting laser radiation): 38 kW $P_m$ (average power of the exiting laser radiation): 6 W t (pulse duration of the laser pulses): 17 ns f (repetition rate of the laser pulses): 10 kHz v (scanning speed on the workpiece surface): 800 mm/s d (diameter of the laser beam on the workpiece): 80 μm α (absorption of the laser radiation of the irradiated material): 15%

$T_v$ (boiling point of the material at normal pressure): 3560 K $c_p$ (specific heat capacity): 580 J/kgK κ (specific thermal conductivity): 22 W/mK This results in ε=1.2, which is to says is in the range required by above Equation 1.

Figure 2:
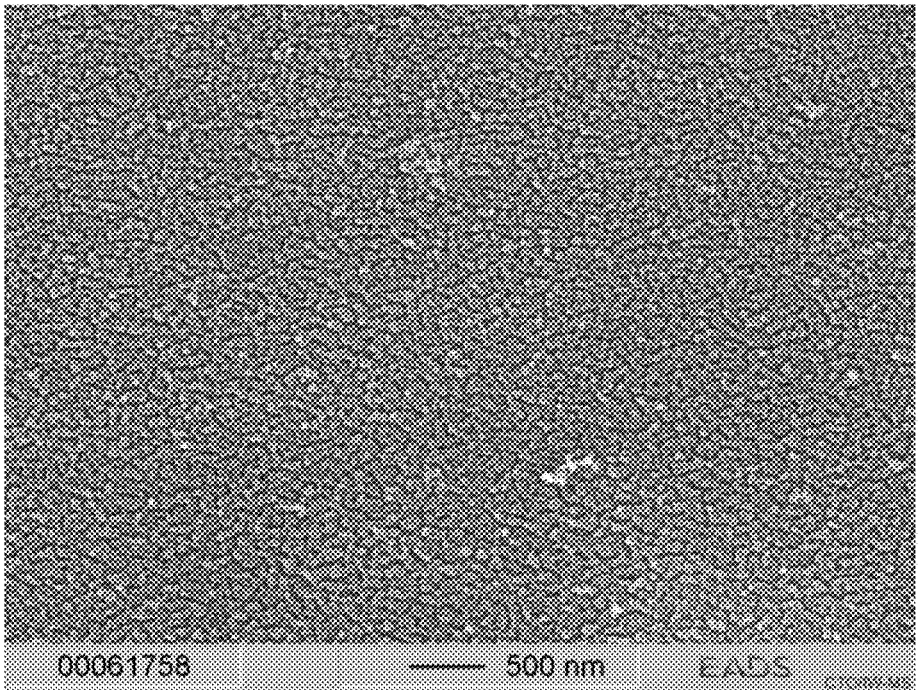
FIG. 2 shows the surface of a Ti-6Al-4V alloy after nanostructuring by way of a laser beam.

The resulting surface is shown in FIG. 2. It is apparent that the surface has a nodule-like nanostructure throughout, but no nanotubes.

Example 1

Nanostructuring a Ti-6Al-4V Surface by Way of Pulsed Laser Radiation in an Inert Atmosphere and Subsequent Anodizing A Ti-6Al-4V workpiece having a pickled surface was scanned once using a diode-pumped Nd:$YVO_4$ (neodymium-doped yttrium orthovanadate) laser (wavelength λ: 1064 nm) in an argon atmosphere at ambient pressure and ambient temperature.

The remaining method parameters were also as described in above Comparison Example 2.

The workpiece, which had a nanostructured surface as described above, was subsequently subjected to anodizing as described in above Comparison Example 1.

Figure 3:
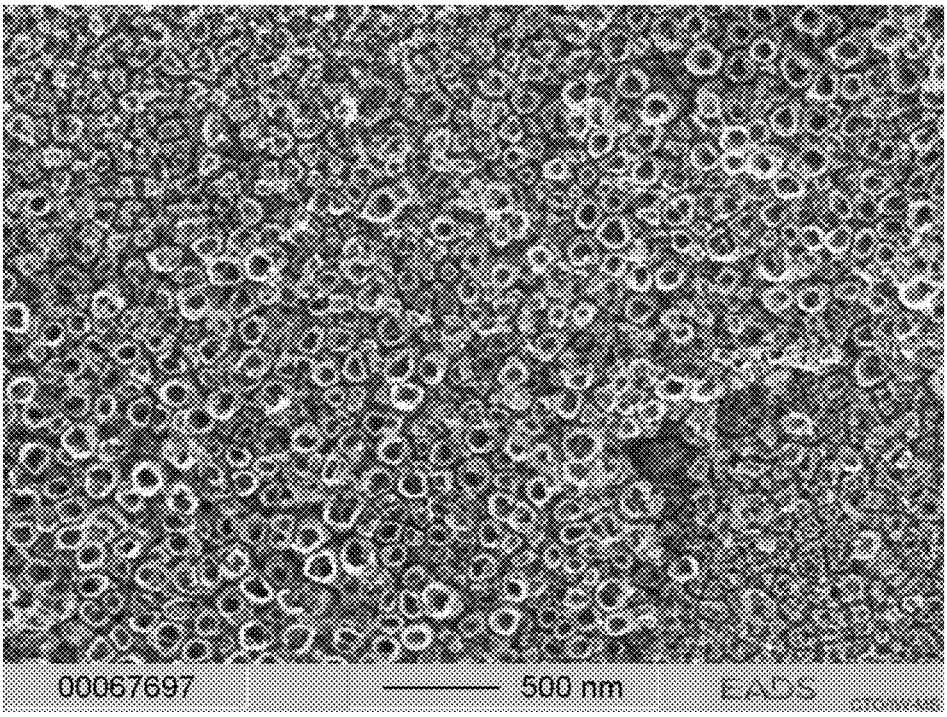
FIG. 3 shows the surface of a Ti-6Al-4V alloy after nanostructuring by way of a laser beam in an argon atmosphere and subsequent anodizing.

The resulting surface is shown in FIG. 3. It is apparent that the entire surface is covered by fine nanotubes and that no unstructured regions whatsoever are present.

Comparison Example 3

Nanostructuring a Ti-6Al-4V Surface by Way of Pulsed Laser Radiation in a Reactive Atmosphere A Ti-6Al-4V workpiece having a pickled surface was scanned once using a diode-pumped Nd:$YVO_4$ (neodymium-doped yttrium orthovanadate) laser (wavelength λ: 1064 nm) in an oxygen atmosphere (pressure approximately 1.5 bar) at ambient temperature.

The remaining method parameters were:

$P_p$ (pulse peak power of the exiting laser radiation): 38 kW $P_m$ (average power of the exiting laser radiation): 6 W t (pulse duration of the laser pulses): 17 ns f (repetition rate of the laser pulses): 10 kHz v (scanning speed on the workpiece surface): 800 mm/s d (diameter of the laser beam on the workpiece): 80 μm α (absorption of the laser radiation of the irradiated material): 15%

$T_v$ (boiling point of the material at normal pressure): 3560 K $c_p$ (specific heat capacity): 580 J/kgK κ (specific thermal conductivity): 22 W/mK This results in ε=1.2, which is to says is in the range according to the invention, which is required by above Equation 1.

Figure 4:
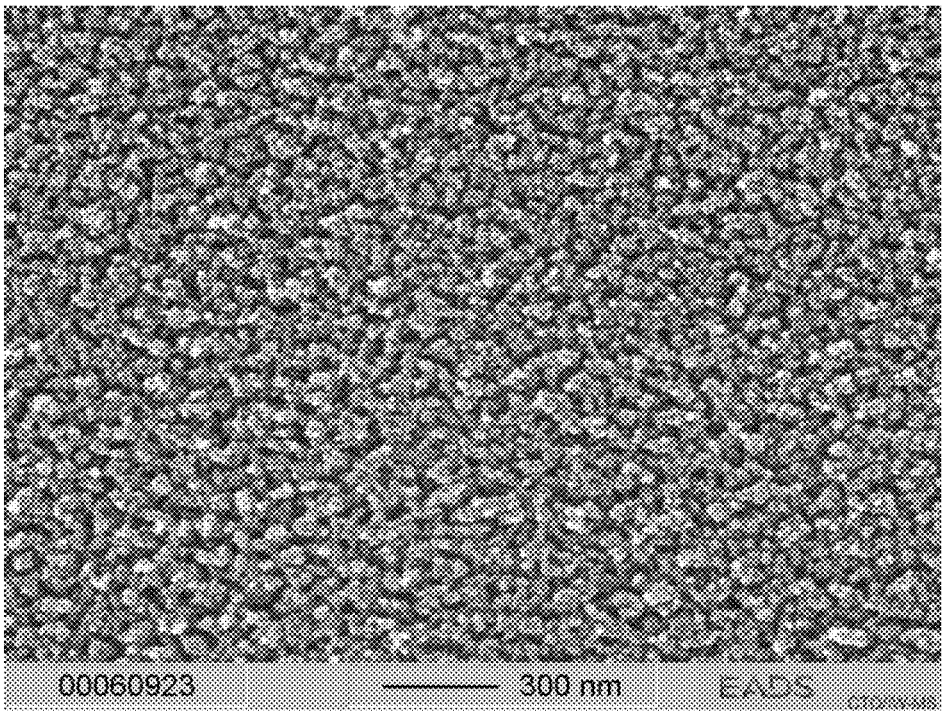
FIG. 4 shows the surface of a Ti-6Al-4V alloy after nanostructuring by way of a laser beam in an oxygen atmosphere.

The resulting surface is shown in FIG. 4. It is apparent that while the surface has a nodule-shaped nanostructure throughout, it has no nanostructures, despite partial oxidation by the oxygen atmosphere, which was detected by way of photoelectron spectroscopy (XPS analysis).

Example 2

Nanostructuring a Ti-6Al-4V Surface by Way of Pulsed Laser Radiation in a Reactive Atmosphere and Subsequent Anodizing A Ti-6Al-4V workpiece having a pickled surface was scanned once using a diode-pumped Nd:$YVO_4$ (neodymium-doped yttrium orthovanadate) laser (wavelength λ: 1064 nm) in an oxygen atmosphere (pressure approximately 1.5 bar) at ambient temperature.

The remaining method parameters were also as described in above Comparison Example 3.

The workpiece, which had a nanostructured surface as described above, was subsequently subjected to anodizing as described in above Comparison Example 1.

Figure 5:
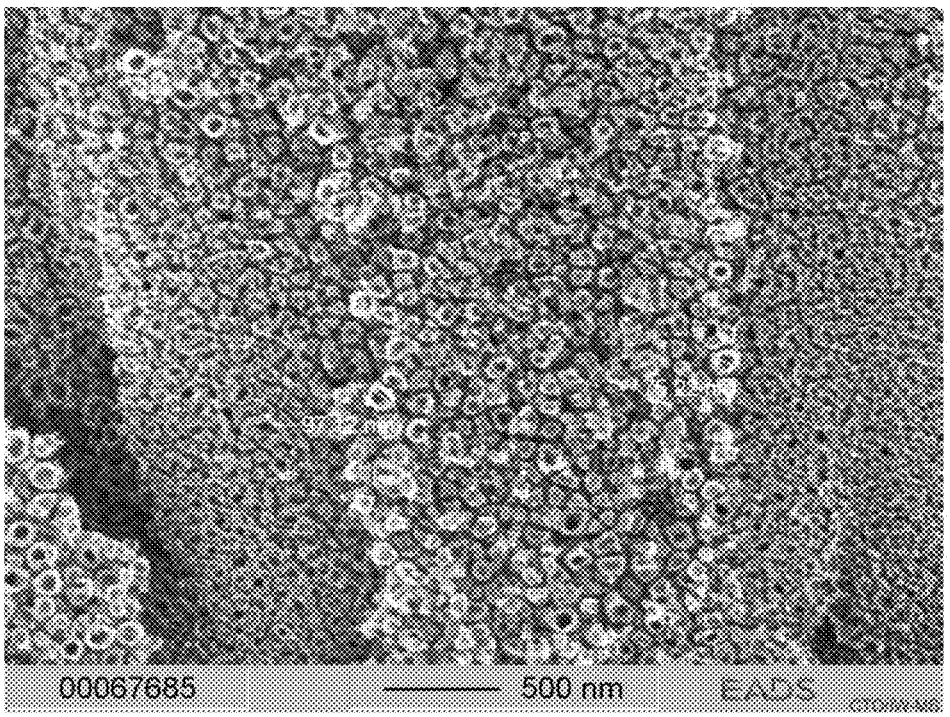
FIG. 5 shows the surface of a Ti-6Al-4V alloy after nanostructuring by way of a laser beam in an oxygen atmosphere and subsequent anodizing.

The resulting surface is shown in FIG. 5. It is apparent that the entire surface is covered by fine nanotubes and that no unstructured regions whatsoever are present.

The invention claimed is:

1. A method for nanostructuring and oxidizing a surface of a material that comprises an anodizable metal alloy, which is at least partially coatable with an oxide layer, the method comprising the steps of:

providing the metal alloy to be laser-scanned with a pulse laser beam;

applying an ε-equation in order to select values for one or more scanning parameters so that an ε-value is approximately 0.07≤ε≤approximately 2300, wherein the ε-equation is:

$$\varepsilon = \frac{P_P^2 \cdot \sqrt{P_m} \cdot f \cdot \alpha \cdot \sqrt{t} \cdot \sqrt{\kappa}}{d^2 \cdot \sqrt{v} \cdot \sqrt{T_V} \cdot \sqrt{c_P} \cdot \sqrt{\lambda}} \cdot 10^3, \quad \text{(Equation 1)}$$

such that the one or more scanning parameters are:

$P_p$: pulse peak power of the exiting laser radiation [kW], t: pulse duration of the laser beam pulses [ns], f: repetition rate of the laser radiation pulses [kHz], v: scanning speed on the metal alloy surface [mm/s], d: diameter of the energetic laser radiation on the metal alloy surface [μm], α: absorption of the energetic laser radiation of the metal alloy [%] at the incident wavelength under normal conditions;

$P_m$: average power of the exiting laser radiation [W], $T_v$: evaporation or decomposition temperature of the metal alloy [K] at normal pressure, $c_p$: specific heat capacity [J/kgK] at normal conditions, κ: specific thermal conductivity [W/mK] at normal conditions and averaged across the different spatial directions, λ: wavelength of the pulsed laser beam; and completely laser-scanning one or more times the surface of the metal alloy with the pulse laser beam in accordance with the selected values for the scanning parameters, so as to generate surface structures in the form of at least one of: open-pored mountain and valley structures, open-pored undercut structures, and nodule-like structures, the scanning being such that neighboring light spots of the pulsed laser beam abut each other without gaps or overlap each other, wherein a pulse duration of the laser pulses is selected in accordance with the ε-equation to be approximately 0.1 ns to approximately 2000 ns, wherein the atmosphere in which the laser-scanning is carried out is a gas or gas mixture that is reactive with respect to the metal alloy of the surface via the laser-scanning, the gas or gas mixture chemically modifying the chemical composition of the metal alloy during or after the laser-scanning, as compared to the chemical composition of the metal alloy prior to the laser-scanning; and subsequently anodizing the surface of the metal alloy via immersion in an electrolyte solution, which contains both an oxidizing agent and an oxide dissolving agent, by connecting to a cathode, and by applying a voltage.

2. The method according to claim 1, wherein the metal alloy is steel or an alloy of a metal selected from: aluminum, titanium, magnesium, iron, cobalt, zinc, niobium, zirconium, hafnium, tantalum, and vanadium.

3. The method according to claim 1, wherein the pressure of the atmosphere in which the method is carried out is in the range of approximately $10^{-6}$ bar to 15 bar, and the temperature outside the laser beam is in the range of approximately −50° C. to approximately 350° C.

4. The method according to claim 1, wherein ε is approximately 0.07ε≤approximately 2000.

5. The method according to claim 1, wherein ε is approximately 0.07ε≤approximately 1500.

6. The method according to claim 1, wherein:

the pulse duration of the laser beam pulses t is approximately 0.1 ns to approximately 300 ns;

the pulse peak power of the exiting laser radiation $P_p$ is approximately 1 kW to approximately 1800 kW;

the average power of the exiting laser radiation $P_m$ is approximately 5 W to approximately 28,000 W;

the repetition rate of the laser radiation pulses f is approximately 10 kHz to approximately 3000 kHz;

the scanning speed on the surface v is approximately 30 mm/s to approximately 19,000 mm/s; and/or the diameter of the energetic laser radiation on the surface d is approximately 20 μm to approximately 4500 μm.

7. The method according to claim 1, wherein ε is approximately 0.07ε≤approximately 1500.

8. The method according to claim 1, wherein ε is approximately 0.9ε≤approximately 1200.

9. The method according to claim 1, wherein ε is approximately 0.07ε≤approximately 1400.

10. The method according to claim 1, wherein ε is approximately 0.9ε≤approximately 1100.

11. The method according to claim 1, wherein the metal alloy is a titanium alloy.

12. The method according to claim 1, wherein the oxide dissolving agent and/or the oxidizing agent contains fluoride ions.

13. The method according to claim 12, wherein the oxidizing agent contains 10 to 1000 g/l ammonium sulfate and the oxide dissolving agent contains 0.1 to 10 g/l ammonium fluoride, and wherein the electrolyte solution is free of hydrofluoric acid.

14. The method according to claim 13, wherein the voltage is 10 to 60 volts, and the anodizing is carried out at a temperature of 20 to 50° C. over a time period of 4 minutes to 24 hours.

15. The method according to claim 1, wherein the anodizing is such that the surface is completely covered by metal alloy oxide, which on the entire surface thereof the surface structures have a diameter of 10 to 300 nm.

16. The method according to claim 15, wherein the metal alloy is a titanium alloy.

17. The method according to claim 1, wherein the surface obtained by the method is joined to a further material, which is selected from complex compounds, composite materials made of inorganic materials and organic materials, and biological materials.

* * * * *